US006251003B1

(12) United States Patent
LeVine

(10) Patent No.: US 6,251,003 B1
(45) **Date of Patent: *Jun. 26, 2001**

(54) HAND-HELD SHARPENING DEVICE

(76) Inventor: Arthur L. LeVine, 2116 Rhonda Ter., Henderson, NV (US) 89014

( * ) Notice: Subject to any disclaimer, the term of this patent is extended or adjusted under 35 U.S.C. 154(b) by 0 days.

This patent is subject to a terminal disclaimer.

(21) Appl. No.: 09/494,389

(22) Filed: Jan. 31, 2000

Related U.S. Application Data

(63) Continuation of application No. 09/069,583, filed on Apr. 29, 1998.

(51) Int. Cl.[7] ..... B24B 33/00

(52) U.S. Cl. ..... 451/557; 451/552; 451/555; 451/423

(58) Field of Search ..... 451/552, 555, 451/557, 558, 423

(56) References Cited

U.S. PATENT DOCUMENTS

| | | | |
|---|---|---|---|
| 935,350 | 9/1909 | Badge et al. | 451/557 |
| 1,630,182 | 5/1927 | Jacobs | 451/555 |
| 2,380,539 | 7/1945 | Miller | 451/557 |
| 3,797,334 | 3/1974 | Sinclair | 451/555 |
| 3,894,362 | 7/1975 | Graves | 51/211 |
| 4,197,677 | 4/1980 | Graves | 451/555 |
| 4,231,194 | 11/1980 | Glesser | 51/211 |
| 4,272,925 | 6/1981 | Graves | 51/211 |
| 4,530,188 | 7/1985 | Graves | 51/214 |
| 4,646,477 | 3/1987 | Robertson | 451/555 |
| 4,696,129 | 9/1987 | Roberts | 451/555 |

*Primary Examiner*—Eileen P. Morgan
(74) *Attorney, Agent, or Firm*—Joseph P. Gastel

(57) ABSTRACT

A hand-held sharpening device for sharpening a blade including an elongated sharpening polygon having a plurality of substantially planar sharpening surfaces for receiving the edge of a blade, opposite ends on the elongated sharpening polygon, a plastic cap covering each of the ends, a graspable extension extending outwardly from one of the caps, and a tie in the form of a chain secured to the graspable extension.

49 Claims, 2 Drawing Sheets

Fig. 4.
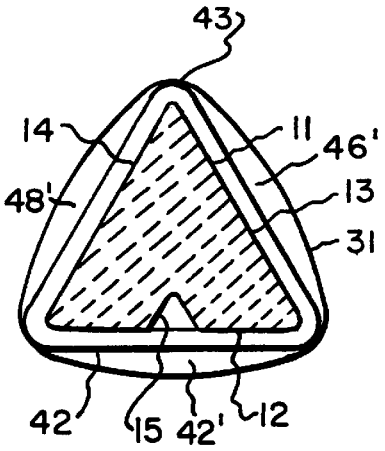
Fig. 5.
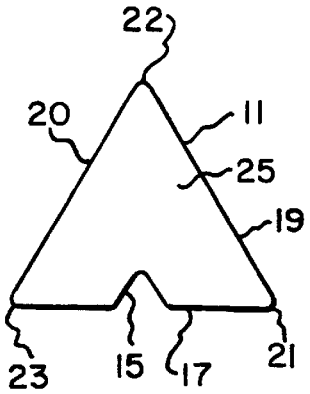
Fig. 6.
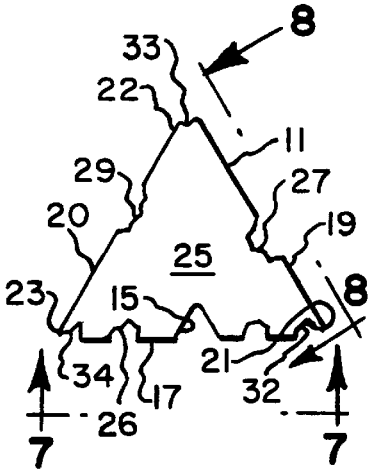
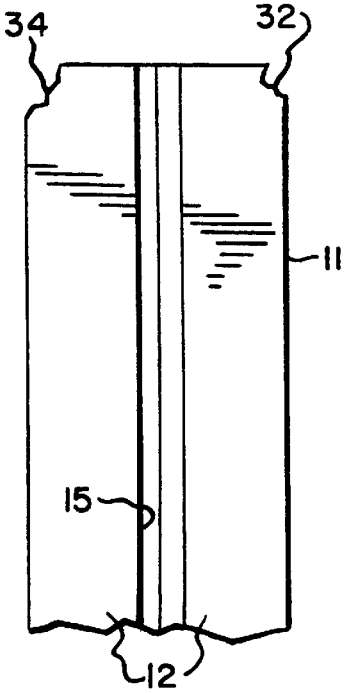
Fig. 7.
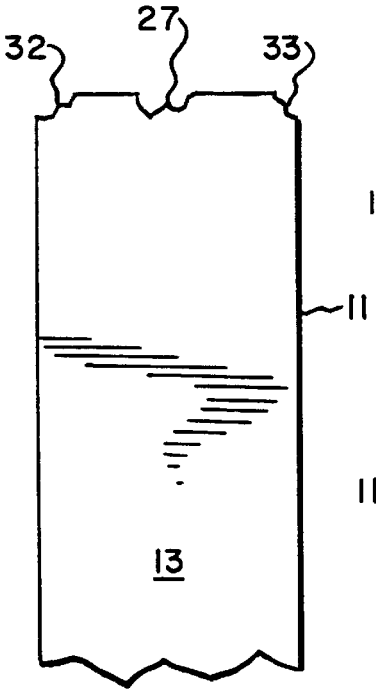
Fig. 8.
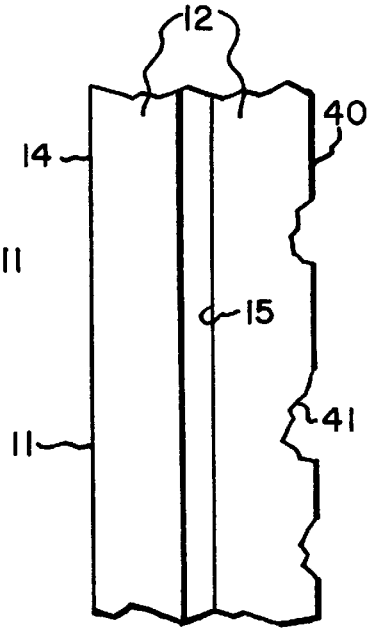
Fig. 9.

HAND-HELD SHARPENING DEVICE

CROSS-REFERENCE TO RELATED APPLICATIONS

This is a continuation of application Ser. No. 09/069,583 filed Apr. 29, 1998

STATEMENT REGARDING FEDERALLY SPONSORED RESEARCH OR DEVELOPMENT

Not Applicable

BACKGROUND OF THE INVENTION

The present invention relates to a hand-held portable sharpener which can be carried in the pocket or suspended from a part of a person's clothing by means of a suitable tie, such as a chain.

By way of background, hand-held portable sharpeners having a cylindrical sharpening stone and end caps are known. However, devices of this type, when used, permit the knife to rotate circumferentially about the cylindrical surface whereby a constant sharpening angle of a knife blade relative to the stone cannot be maintained.

BRIEF SUMMARY OF THE INVENTION

It is one object of the present invention to provide an improved portable hand-held blade sharpener in the form of a polygon having a plurality of substantially planar sharpening surfaces against each of which a constant sharpening angle may be maintained.

Another object of the present invention is to provide an improved hand-held portable sharpening device in the form of an elongated polygon wherein the straight edges and vertices at its opposite ends are protected against chipping or nicking by plastic end caps.

A further object of the present invention is to provide an improved hand-held portable sharpener which can be conveniently grasped at one end thereof during a knife sharpening operation. Other objects and attendant advantages of the present invention will readily be perceived hereafter.

The present invention relates to a hand-held sharpening device for sharpening a blade comprising an elongated sharpening polygon having a plurality of elongated substantially planar sharpening surfaces for receiving the edge of a blade, an end portion on said elongated sharpening polygon, a plurality of straight edges on said end portion, and a cap covering said straight edges and extending onto said end portion of said polygon.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 4 is an enlarged cross sectional view taken substantially along line 4—4 of FIG. 1;

FIG. 5 is an enlarged view taken substantially in the direction of arrow 5—5 of FIG. 1 and showing the straight edges and the vertices at the end of the elongated sharpening polygon;

FIG. 6 is a view similar to FIG. 5 but showing the manner in which the straight edges and vertices can be nicked by contact with hard objects in the event they are not protected by a cap;

FIG. 7 is an enlarged fragmentary side elevational view taken substantially in the direction of arrows 7—7 of FIG. 6;

FIG. 8 is an enlarged fragmentary side elevational view taken substantially in the direction of arrows 8—8 of FIG. 6; and FIG. 9 is an enlarged fragmentary side elevational view taken substantially in the direction of arrows 9—9 of FIG. 3 and showing the manner in which an edge of the sharpening polygon may be chipped.

DETAILED DESCRIPTION OF THE INVENTION

Figure 1:
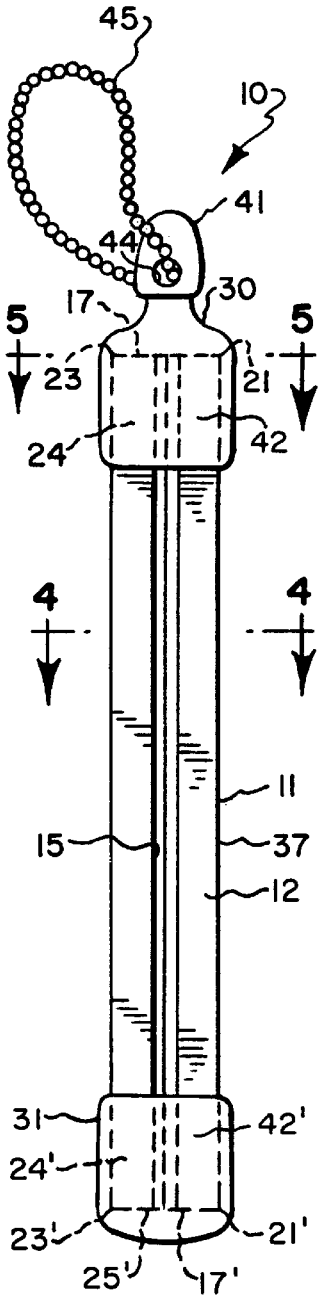
FIG. 1 is a side elevational view of the hand-held blade sharpening device of the present invention.

The hand-held sharpening device 10 includes a sharpening polygon 11 of suitable ceramic material having three substantially planar sharpening surfaces 12, 13 and 14, the cross section of which constitutes an equilateral triangle, as can be seen from FIG. 4. Face 12 includes a groove 15 for sharpening points of objects, such as fish hooks. It will be appreciated that other polygonal shapes having substantially planar sharpening surfaces can be used.

Sharpening polygon 11 terminates at straight edges 17, 19 and 20 (FIG. 5) at its upper end, and it terminates at corresponding straight edges 17', 19' and 20' at its lower edges. Straight end 17, 19 and 37 meet at a vertex 21; straight edges 19, 20 and 39 meet at a vertex 22; and straight edges 20, 17 and 40 meet at a vertex 23. At the opposite end of sharpening polygon 11, straight edges 17', 19' and 37 meet at a vertex 21'; straight edges 19', 20' and 39 meet at a vertex 22'; and straight edges 20', 17' and 40 meet at a vertex 23'.

The sharpening polygon 11 taken by itself without end caps 30 and 31 thereon is approximately 4 inches long. When the sharpening polygon 11 is unprotected without the end caps 30 and 31, its straight edges, such as 17, 19 and 20, (FIG. 6) may be chipped at 26, 27 and 29, respectively, and also the vertices 21, 22 and 23 may also be chipped at 32, 33 and 34, respectively, as shown in FIG. 6, because the ceramic material of which polygon 11 is made is frangible and extremely susceptible of chipping. Analogous chipping can occur at the analogous edges and vertices at the opposite end 24' of the sharpening polygon. The sharpening polygon 11, by itself, without end caps 30 and 31 thereon, if carried in a person's pocket, will cause undue wear as the vertices 21, 22 and 23 dig into the pockets, and this is especially pronounced when the vertices are jagged due to chipping as shown at 32, 33 and 34 and at the corresponding vertices at the opposite end. Also, the nicked or jagged portions, such as 26, 27 and 29, essentially act as serrated edges which not only can wear out a pocket but also can abrade the user's hand. Under extreme conditions the ceramic can fracture and become a true razor-like edge which would be extremely sharp and dangerous.

Figure 2:
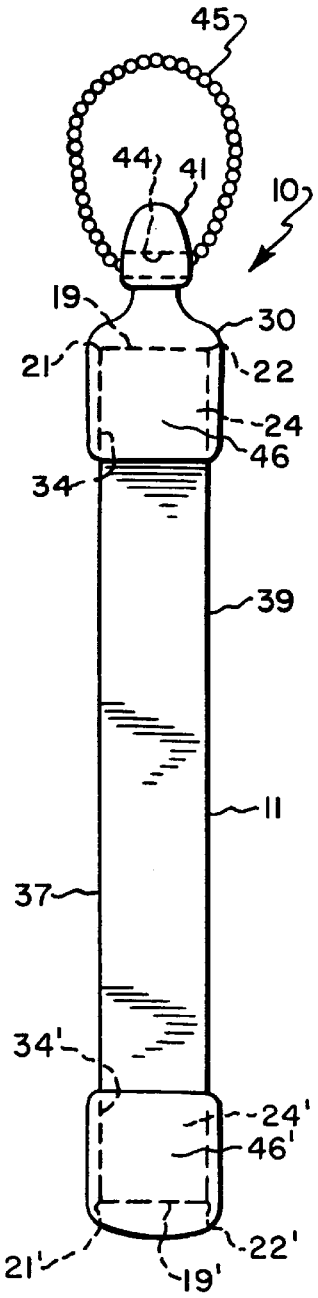
FIG. 2 is a side elevational view of the device rotated 120° to the left from its position of FIG. 1.
Figure 3:
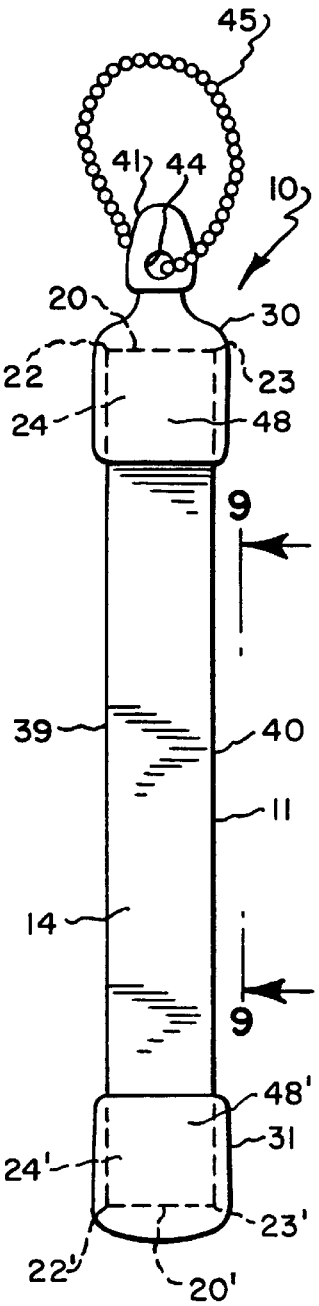
FIG. 3 is a side elevational view of the device rotated 120° to the left from its position of FIG. 2.

In order to remedy the foregoing, molded plastic end caps 30 and 31 are mounted onto the end portions 24 and 24', respectively, to thereby protect the straight edges and the vertices at which the various straight edges meet. As can be seen from FIG. 2, end cap 30 includes a cavity 34 which fits in complementary mating relationship over end 24. Also, cap 31 includes a cavity 34' which receives polygon end 24' in complementary mating relationship. Caps 30 and 31 not only protect the edges and vertices which they cover from chipping, but they also tend to cushion the polygon 11 against fracture in the event it is dropped on a hard surface. The fracture can readily occur because the ceramic material is in the nature of glass which shatters easily. Also, since end caps 30 and 31 are mounted on the ends of the ceramic member, there is a high probability that its longitudinal edges 37, 39 and 40 will not contact a hard surface such that a chipped edge, such as 41, will be produced. If the latter occurs, the surfaces 12 and 14 adjacent edge 40 will be rendered useless for sharpening, as it is necessary that such edges should remain straight for a proper sharpening operation.

The hand-held sharpener 10 may conveniently be held at one end for sharpening. In this respect, a graspable extension 41 is molded integrally with end cap 30 and extends outwardly therefrom about ¾ of an inch. This graspale extension may be held between the thumb and forefinger. Alternatively, the end cap 30 or the end cap 31 may also be held between the thumb and the forefinger with the thumb resting on a relatively flat surface such as 42 (FIGS. 1 and 4) and the vertex 43 of the cap opposite to surface 42 resting at the first joint of the forefinger. Surfaces 46 and 48 are flat surfaces which are analogous to flat surface 42. Surfaces 42, 46 and 48 of cap 30 are essentially mirror images of surfaces 42', 46' and 48', respectively, of cap 31 (FIG. 4). Alternatively, an end cap, such as 30, can be held with the thumb on one flat surface thereof, the tip of the forefinger on another flat surface, and the side of the middle finger on the third flat surface.

A hole 44 extends through graspable extension 41 and a tie 45, in the form of a chain, extends through hole 44. The chain can be used to suspend sharpener 10 from any suitable object, such as clothing or a brief case, for ready access. Additionally, the chain may be used as an adjunct to graspable extension 41 for stabilizing the sharpening 10 when it is held at one end. In this respect, the chain would lie within the grasp of the second joints of the middle, fourth and little fingers while the thumb and forefinger bear on the cap itself.

It can thus be seen that the improved hand-held sharpener of the present invention is manifestly capable of achieving the above enumerated objects, and while a preferred embodiment of the present invention has been disclosed, it will be appreciated that it is not limited thereto but may be otherwise embodied within the scope of the following claims.

What is claimed is:

1. A hand-held sharpening device for sharpening a blade comprising an elongated sharpening polygon having a plurality of elongated substantially planar sharpening surfaces for receiving the edge of a blade, a plurality of first straight edges at the junctions of said elongated substantially planar sharpening surfaces, an end portion on said elongated sharpening polygon, a plurality of second straight edges on said end portion extending transversely to said first straight edges, vertices at the junctions of said first and second straight edges, and a cap on said end portion covering said vertices and said first and second straight edges on said end portion.

2. A hand-held sharpening device as set forth in claim 1 including a graspable extension extending outwardly from said cap.

3. A hand-held sharpening device as set forth in claim 2 including a tie attached to said graspable extension.

4. A hand-held sharpening device as set forth in claim 2 wherein said graspable extension is of less girth than said cap.

5. A hand-held sharpening device as set forth in claim 1 wherein said polygon is of triangular cross section.

6. A hand-held sharpening device as set forth in claim 5 including a graspable extension extending outwardly from said cap.

7. A hand-held sharpening device as set forth in claim 6 including a tie attached to said graspable extension.

8. A hand-held sharpening device as set forth in claim 6 wherein said graspable extension is of less girth than said cap.

9. A hand-held sharpening device as set forth in claim 1 including a second end portion at the opposite end of said elongated sharpening polygon from said end portion, a plurality of third straight edges on said second end portion, second vertices at the junctions of said first and third straight edges, and a second cap on said second end portion covering said second vertices and said first and third straight edges on said second end portion.

10. A hand-held sharpening device as set forth in claim 9 including a graspable extension extending outwardly from said cap.

11. A hand-held sharpening device as set forth in claim 9 wherein said second cap is a plastic molded member.

12. A hand-held sharpening device as set forth in claim 11 including a tie attached to said cap.

13. A hand-held sharpening device as set forth in claim 9 including a tie attached to said cap.

14. A hand-held sharpening device as set forth in claim 9 wherein said polygon is of triangular cross section.

15. A hand-held sharpening device as set forth in claim 14 including a graspable extension extending axially outwardly from said cap.

16. A hand-held sharpening device as set forth in claim 15 wherein said tie is attached to said graspable extension.

17. A hand-held sharpening device as set forth in claim 15 wherein said graspable extension is of less girth than said cap.

18. A hand-held sharpening device for sharpening a blade comprising an elongated sharpening polygon having a plurality of elongated substantially planar sharpening surfaces for receiving the edge of a blade, said elongated substantially planar surfaces intersecting at first edges, an end portion on said elongated sharpening polygon, portions of said first edges extending onto said end portion, a plurality of second edges on said end portion, said second edges intersecting said portions of said first edges at vertices, and a cap on said end portion of said polygon and covering said vertices and said second edges and said portions of said first edges on said end portion.

19. A hand-held sharpening device as set forth in claim 18 including a graspable extension extending axially outwardly from said cap.

20. A hand-held sharpening device as set forth in claim 19 including a tie attached to said graspable extension.

21. A hand-held sharpening device as set forth in claim 19 wherein said graspable extension is of less girth than said cap.

22. A hand-held sharpening device as set forth in claim 18 wherein said polygon is of triangular cross section.

23. A hand-held sharpening device as set forth in claim 18 including a second end portion on said elongated sharpening polygon at the opposite end of said elongated sharpening polygon from said end portion, second portions of said first edges extending onto said second end portion, a plurality of third edges on said second end portion, said third edges intersecting said second portions of said first edges at second vertices, and a second cap on said second end portion of said polygon and covering said second vertices and said third edges and said second portions of said first edges on said second end portion.

24. A hand-held sharpening device as set forth in claim 23 wherein said polygon is of triangular cross section.

25. A hand-held sharpening device as set forth in claim 23 including a graspable extension extending axially outwardly from said cap.

26. A hand-held sharpening device as set forth in claim 25 including a tie attached to said graspable extension.

27. A hand-held sharpening device as set forth in claim 25 wherein said graspable extension is of less girth than said cap.

28. A hand-held sharpening device as set forth in claim 18 including a tie attached to said cap.

29. A hand-held sharpening device as set forth in claim 28 wherein said polygon is of triangular cross section.

30. A hand-held sharpening device for sharpening a blade comprising an elongated sharpening polygon having a plurality of elongated substantially planar sharpening surfaces and a grooved surface, said elongated substantially planar surfaces and said grooved surface intersecting at first edges, an end portion on said elongated sharpening polygon, portions of said first edges extending onto said end portion, a plurality of second edges on said end portion, said second edges intersecting said portions of said first edges at vertices, and a cap on said end portion of said polygon.

31. A hand-held sharpening device as set forth in claim 30 wherein said cap covers said vertices and said second edges and said portions of said first edges on said end portion.

32. A hand-held sharpening device as set forth in claim 30 including a second end portion on said elongated sharpening polygon at the opposite end of said elongated sharpening polygon from said end portion, second portions of said first edges extending onto said second end portion, a plurality of third edges on said second end portion, said third edges intersecting said second portions of said first edges at second vertices, and a second cap on said second end portion of said polygon.

33. A hand-held sharpening device as set forth in claim 32 wherein said second cap covers said second vertices and said third edges and said second portions of said first edges on said second end portion.

34. A hand-held sharpening device as set forth in claim 33 wherein said cap covers said vertices and said second edges and said portions of said first edges on said end portion.

35. A hand-held sharpening device for sharpening a blade comprising an elongated sharpening polygon having at least one elongated substantially planar sharpening surface and at least one grooved surface, said elongated substantially planar surface and said grooved surface intersecting at at least one first edge, an end portion on said elongated sharpening polygon, a portion of said first edge extending onto said end portion, a plurality of second edges on said end portion, said second edges intersecting said portion of said at least one first edge at a vertex, and a cap on said end portion of said polygon.

36. A hand-held sharpening device as set forth in claim 35 wherein said cap covers said vertex and said second edges and said portion of said at least one first edge on said end portion.

37. A hand-held sharpening device as set forth in claim 35 including a second end portion on said elongated sharpening polygon at the opposite end of said elongated sharpening polygon from said end portion, a second portion of said at least one first edge extending onto said second end portion, a plurality of third edges on said second end portion, said third edges intersecting said second portion of said at least one first edge at a second vertex, and a second cap on said second end portion of said polygon.

38. A hand-held sharpening device as set forth in claim 37 wherein said second cap covers said second vertex and said third edges and said second portion of said at least one first edge on said second end portion.

39. A hand-held sharpening device as set forth in claim 38 wherein said cap covers said vertex and said second edges and said portion of said at least one first edge on said end portion.

40. A hand-held sharpening device for sharpening a blade comprising an elongated sharpening polygon having a plurality of elongated substantially planar sharpening surfaces for receiving the edge of a blade, said elongated substantially planar surfaces intersecting at at least one first edge, an end portion on said elongated sharpening polygon, a portion of said at least one first edge extending onto said end portion, a plurality of second edges on said end portion, said second edges intersecting said portion of said at least one first edge at a vertex, and a cap on said end portion of said polygon.

41. A hand-held sharpening device as set forth in claim 40 wherein said cap covers said vertex and said second edges and said portion of said at least one first edge on said end portion.

42. A hand-held sharpening device as set forth in claim 40 including a second end portion on said elongated sharpening polygon at the opposite end of said elongated sharpening polygon from said end portion, a second portion of said at least one first edge extending onto said second end portion, a plurality of third edges on said second end portion, said third edges intersecting said second portion of said at least one first edge at a second vertex, and a second cap on said second end portion of said polygon.

43. A hand-held sharpening device as set forth in claim 42 wherein said second cap covers said second vertex and said third edges and said second portion of said at least one first edge on said second end portion.

44. A hand-held sharpening device as set forth in claim 43 wherein said cap covers said vertex and said second edges and said portion of at least one first edge on said end portion.

45. A hand-held sharpening device for sharpening a blade comprising an elongated sharpening polygon having a plurality of sharpening surfaces including at least one substantially planar sharpening surface and at least one grooved sharpening surface, at least one first edge on said substantially planar sharpening surface, at least one second edge on said grooved sharpening surface, an end portion on said elongated sharpening polygon, portions of said at least one first edge and said at least one second edge extending onto said end portion, a plurality of third edges on said end portion, said third edges intersecting said portion of said at least one first edge and said portion of said at least one second edge at vertices, and a cap on said end portion of said polygon.

46. A hand-held sharpening device as set forth in claim 45 wherein said cap covers said vertices and said third edges and said portion of said at least one first edge and said portion of said at least one second edge on said end portion.

47. A hand-held sharpening device as set forth in claim 45 including a second end portion on said elongated sharpening polygon at the opposite end thereof from said end portion, second portions of said at least one first edge and said at least one second edge extending onto said second end portion, a plurality of fourth edges on said second end portion, said fourth edges intersecting said second portions of said at least one first edge and said at least one second edge at second vertices, and a second cap on said second end portion.

48. A hand-held sharpening device as set forth in claim 47 wherein said second cap covers said second vertices and said fourth edges and said second portions of said first and second edges on said second end portion.

49. A hand-held sharpening device as set forth in claim 48 wherein said cap covers said vertices and said third edges and said portion of said at least one first edge and said portion of said at least one second edge on said end portion.

* * * * *